United States Patent [19]

Greene

[11] Patent Number: 4,694,750

[45] Date of Patent: Sep. 22, 1987

[54] PRINTING PRESS CYLINDER WITH AXIALLY ADJUSTABLE CORD ANTI-SMEAR DEVICES

[76] Inventor: Joe A. Greene, 3176 South 76 East Ave., Tulsa, Okla. 74145

[21] Appl. No.: 5,323

[22] Filed: Jan. 15, 1987

Related U.S. Application Data

[63] Continuation of Ser. No. 800,560, Nov. 21, 1985, abandoned.

[51] Int. Cl.[4] ..... B41F 21/00

[52] U.S. Cl. ..... 101/426; 101/420

[58] Field of Search ..... 101/415.1, 420, 421, 101/417–419, 416 R

[56] References Cited

U.S. PATENT DOCUMENTS

| | | | |
|---|---|---|---|
| 2,005,046 | 6/1935 | Newcomb | 101/420 |
| 2,085,845 | 7/1937 | Binkley | 101/420 |
| 2,555,319 | 6/1951 | Cross | 101/420 |
| 2,740,355 | 4/1956 | Wimpfheimer | 101/420 |
| 3,126,826 | 3/1964 | Fischer | 101/420 |

FOREIGN PATENT DOCUMENTS

| | | | |
|---|---|---|---|
| 1179559 | 10/1964 | Fed. Rep. of Germany | 101/420 |
| 703992 | 2/1954 | United Kingdom | 101/415.1 |

*Primary Examiner*—Eugene H. Eickholt
*Attorney, Agent, or Firm*—Robert E. Massa

[57] ABSTRACT

An antismear transfer cylinder controls movement of a freshly inked sheet through an offset printing press while protecting the sheet from smearing. The antismear cylinder is mountable adjacent an impression cylinder of the printing press and comprises a cylindrical portion of resilient material mounted on a support wheel. The cylindrical portion includes a pair of axially oriented flanges to provide means for securing the cylindrical portion to the support wheel. The cylindrical portion also includes a circumferential granular surface. An elastic member is attachable to each flange and is stretchably positionable around the circumferential granular surface.

16 Claims, 4 Drawing Figures

PRINTING PRESS CYLINDER WITH AXIALLY ADJUSTABLE CORD ANTI-SMEAR DEVICES

This is a continuation of co-pending application Ser. No. 800,560 filed on Nov. 21, 1985 and now abandoned.

FIELD OF THE INVENTION

My invention relates generally to printing presses, and more particularly, to apparatus for preventing the smearing of ink on a freshly inked sheet of paper as it moves through a printing press after printing. Still more particularly, my invention relates to antismear cylinders adaptable for rotary printing presses to prevent smearing of ink on a freshly inked sheet of paper as it moves through a printing press after printing.

BACKGROUND OF THE INVENTION

In the art of printing, the printer has always devoted special attention to the manner in which he has handled the freshly printed sheets so that the ink would not smear. The ink on freshly printed sheets never dries immediately, and the ink is particularly prone to smear when the sheets are stacked one upon another.

As printing presses developed and became capable of achieving increasingly higher printing speeds, the probability also increased greatly that the freshly printed sheets would become smeared. Then, with the recognition of this problem, many different methods were devised to lessen the chances of ink smearing as the printed material passed through various components of a printing press, or as the printed sheets were collected in stacks at the end of the printing process.

Rotary printing presses, whether of the offset type, letter-press type, or multicolor type, always include a transfer mechanism to guide the movement of the freshly printed sheets between two stages of the printing operation. The transfer mechanism may be in the form of a transfer drum, an antismear cylinder, or one or more skeleton wheels.

During the transfer of the printed sheets from one stage of the printing press to the next, the face of the freshly printed sheet which bears the fresh ink may be subject to contact with a portion of the transfer mechanism. The need arises to reduce the area of the transfer mechanism which contacts this freshly inked face.

If the transfer mechanism is a form of transfer drum or cylinder, many different means have been incorporated into such a transfer mechanism to reduce the area of contact. Transfer drums have been designed with uneven surfaces, or with loose fabric material covering the surface of the drum, or with granular material spread sparsely over the drum in a particular pattern.

Skeleton wheels are normally thin wheels secured on a shaft adjacent one stage in a printing press in a manner that the thin circumferential surface of the wheel may contact only a chosen, reduced area on the freshly printed side of a sheet to perform its function of guiding the sheet to the next stage of the operation. Skeleton wheels may be slidable along the shaft upon which they are mounted so that the printer may select positions for the wheels which will provide the least area of contact of the wheels with printed matter, thereby reducing the likelihood of smearing.

I have found prior art which exeaplifies the concepts I have described above.

This prior art includes the following material:

| | | |
|---|---|---|
| U.S. Pat. No. 1,731,467 | Knowlton | Oct. 15, 1929 |
| U.S. Pat. No. 2,085,845 | Binkley | July 6, 1937 |
| U.S. Pat. No. 2,152,263 | Knowlton | March 28, 1939 |
| U.S. Pat. No. 2,555,319 | Cross | June 5, 1951 |
| U.S. Pat. No. 2,740,355 | Wimpfheimer | April 3, 1956 |
| U.S. Pat. No. 3,261,288 | Dickerson | July 19, 1966 |
| U.S. Pat. No. 3,308,522 | Miller | March 14, 1967 |
| U.S. Pat. No. 4,402,267 | DeMoore | Sept. 6, 1983 |
| German 261,143 | Maschinenfabrik Augs. | June 18, 1913 |
| European Application 36,937 | to Thoms | Feb. 17, 1981 |

SUMMARY OF THE INVENTION

The primary object of my invention is to provide an antismear device for a printing press for effectively preventing the smearing of ink on a freshly inked sheet as the sheet moves through the printing press.

Another object of my invention is to provide an antismear device for a printing press which is simple in construction, easy to make, and easy to use.

Still another object of my invention is to provide an antismear device for a printing press which is adaptable to be easily mountable in an existing printing press.

Still another object of my invention is to provide an antismear cylinder for a conventional rotary printing press which is easily attachable to the printing press and may be quickly attached thereto.

Still another object of my invention is to provide an antismear device for a printing press which is easily and quickly adjustable to permit a chosen portion of the antismear device to contact a chosen portion of the freshly inked sheet as the sheet passes through the printing press.

Still another object of my invention is to provide an antismear device for a printing press which is adaptable for easy mounting adjacent a cylinder of a rotary offset printing press for effectively preventing smearing of a freshly inked sheet as the sheet emerges from the printing area.

Still another object of my invention is to provide an antismear cylinder for a printing press which will assist in delivering a freshly inked sheet while ink is still wet, while at the same time not allowing the sheet to "cave in".

Still another object of my invention is to provide an antismear cylinder for a printing press which may be easily and quickly adjusted to permit a selected portion of the antismear cylinder to contact a minimum area of a freshly inked sheet as the sheet passes through the printing press.

Other objects of my invention will become apparent from the following written description and drawings of my invention.

I have been a professional printer for many years, and, as a consequence, I have been aware of the problem of the smearing of the ink on freshly inked sheets and of the many attempts to solve or reduce this problem, as I have summarized above.

I have, in my present invention, provided an antismear device for a printing press which incorporates the further advantages of being able to control effectively the movement of the freshly inked sheet; of helping to prevent curling of a freshly inked sheet; and, under some conditions, of being able to eliminate static charges from the moving sheets.

With my invention I am providing an antismear cylinder for a printing press in which the cylinder is formed by mounting a sheet of resilient material around a support wheel, with the support wheel being mountable on a transverse shaft of the printing press near the printing area. The sheet of resilient material may include, for instance, a sheet of resilient sheet metal which has a granular surface. The granular surface may be formed either by granular material applied adhesively to the resilient sheet, or be an abrasive sheet, such as sandpaper, applied adhesively to the resilient sheet.

The granular material should be evenly distributed over the surface of the resilient sheet, or over the surface of the adhesively attached sheet, thereby providing support and guidance over essentially the entire freshly inked sheet.

The resilient sheet forms an incomplete cylinder around the supporting skeleton wheels, or, in effect, a cylindrical portion, in order to permit quick and easy attachment of the resilient sheet to the skeleton wheels. The cylindrical portion of resilient material includes an axially oriented flange at each axial end of the cylindrical portion to provide means for easily and quickly securing the resilient material to the support wheels. Each flange includes means for attachment of the flange to the support wheels.

In cooperation with the antismear capabilities furnished by the design of the circular portion of resilient material of my invention, I have provided a pair of elastic members which are stretchably positionable around the circumferential granular surface of the circular portion. Each elastic member is a cord-like stretchable member which has a connecting means at each end for cooperation with securing means of each flange. The printer may easily and quickly adjust the elastic cord-like member axially along the flange member to a chosen position which he considers will provide the most efficient antismearing capacity for the antismear transfer cylinder. Thus, he considers many factors when he adjusts the position of the elastic member, including: the size of the sheet to be printed, the type of material of the sheet to be printed, the size of the type matter, the composition of the ink to be used, etc.

In addition to giving the printer the opportunity to position the elastic members as best might enhance the antismear capabilities of his printing, the printer has the further advantage from the elastic members of assisting the transfer cylinder with its granular surface in stabilizing the printed sheet. The use of, and positioning of, the elastic members are significantly more important when the printing is to be done on coated or glossy sheets.

Several of the patents cited above describe the use of granularly-coated surfaces for components of printing presses as a means of providing antismear capabilities for the printing presses. However, in summary, as I have discussed, for most printing jobs, the use of a granularly-coated antismear sheet by itself is not sufficient. I became aware of this problem, and thereby developed my present invention.

Normally, the space within a printing press between my antismear cylinder and the impression cylinder is limited, and very little, or no adjustment is available to me for the positioning of my antismear cylinder. I have provided an antismear cylinder which is sufficiently resilient to compensate for any lack of available adjustability of the printing press. The sheet of resilient material forming the circumferential surface of the antismear device is sufficiently thin, and of proper resilience, to provide firm support to the printed sheet and yet to yield enough under the printing pressure as not to cause damage to the printed sheet or interruption of the printing operation.

Also, wherever it may be placed, an elastic member will flex sufficiently under the pressure of the impression cylinder at that particular area of contact with the impression cylinder to stabilize the movement of the printed sheet while at the same time not causing damage to the elastic member or printed sheet. Further, the flexibility of the elastic member will avoid any problem of folding of a printed sheets as it moves between the impression cylinder and the antismear cylinder.

Generally, therefore, I may describe my invention as an antismear cylinder for a printing press, comprising: a cylindrical portion formed by mounting a sheet of resilient material around a support wheel, the cylindrical portion having a circumferential granular surface; an axially oriented flange along an axial end of the cylindrical portion, including means for securing the flange to the support wheel; and an elastic member adaptable to be attachable to the flange in a manner that the elastic member may be stretchably positionable around the circumferential granular surface.

DESCRIPTION OF THE PREFERRED EMBODIMENTS

Figure 1:
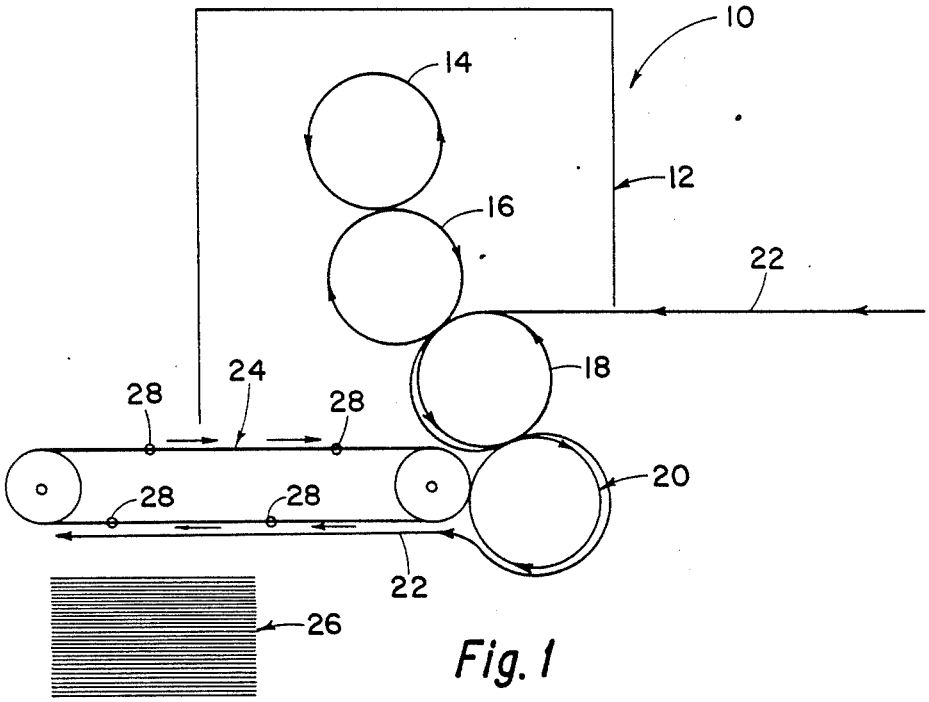
FIG. 1 is a schematic side view of major components of a typical rotary offset printing press illustrating the relationship of an antismear device of my invention with the other major components of the printing press.

FIG. 1 describes schematically the main operating components of a typical rotary offset printing press 10, generally, which includes a base frame 12, generally, shown in partial, which supports a plate cylinder 14, a blanket cylinder 16, an impression cylinder 18, and an antismear device 20, generally, according to my invention, all cooperating to perform the printing operation. Then, also I am showing in FIG. 1 the movement of paper feed stock 22 through the printing press 10 in the direction indicated.

The printing press components guide the paper feed stock 22 between blanket cylinder 16 and impression cylinder 18 for printing, and then between impression cylinder 18 and antismear device 20 for cooperation with a typical conveyor system 24, generally, for eventual accumulation in printed paper stack 26, generally, from which the printed sheets may be removed as desired.

For clarity, I have omitted from the schematic diagram of FIG. 1 various operating, supporting and guiding components which are present in a conventional printing press, such as means for supplying ink to the plate cylinder, means for driving the numerous components of the printing press, the additional rollers which support the paper feed stock 22 as it moves through the press, and other members which are usually provided for guiding the paper through the press.

In FIG. 1 I have also shown schematically a plurality of grippers 28 which are usually provided for holding the paper stock 22 as it moves through the press.

I have shown the paper feed stock 22 as a long, continuous portion of a roll in order to clearly show the movement of the paper through the press as it is being printed and as it is being handled after having been printed. However, in the conventional printing press, the paper may be in the form of individual sheets instead of roll stock.

In FIG. 1 I have shown the paper stock 22 after printing and cutting as a stack 26, generally, of freshly printed and cut material. The printed sheets 22 accumulated in stack 26 are now ready for removal from the printing press and distribution as planned.

The typical rotary offset process which I have shown schematically in FIG. 1 comprises the steps of: applying ink to the surface of typeform attached to the plate cylinder 14, transferring the ink (in the form of the letters or characters making up the typeform on the plate cylinder) from the plate cylinder 14 to the blanket cylinder 16, transferring the ink letters or characters (i.e. printing) from the blanket cylinder 16 to the paper feed stock 22 with the assistance of the pressure provided by the impression cylinder 18 as it presses the paper against the blanket cylinder.

It should be understood, however, that plate cylinder 14 may include, generally, any kind of rotary plate in common use, whether in an offset press, rotary letterpress, rotary gravure press, or letterset press, since the dominant feature of my invention is to protect the freshly inked sheet from smearing in moving through the press and my invention world be adaptable to any of the present printing presses employing plate cylinders and impression cylinders.

Figure 2:
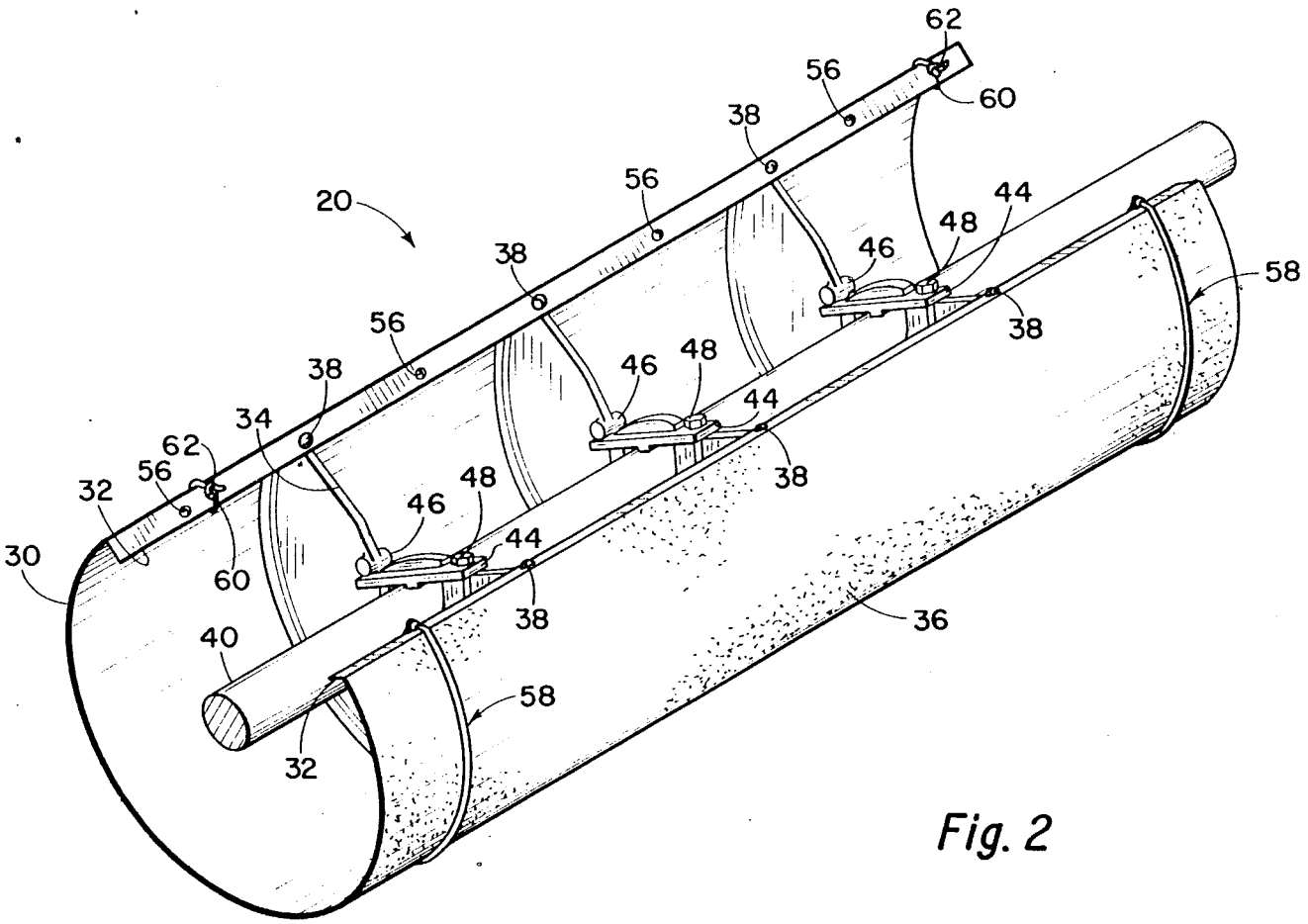
FIG. 2 is an isometric view of an antismear device according to my invention.
Figure 4:
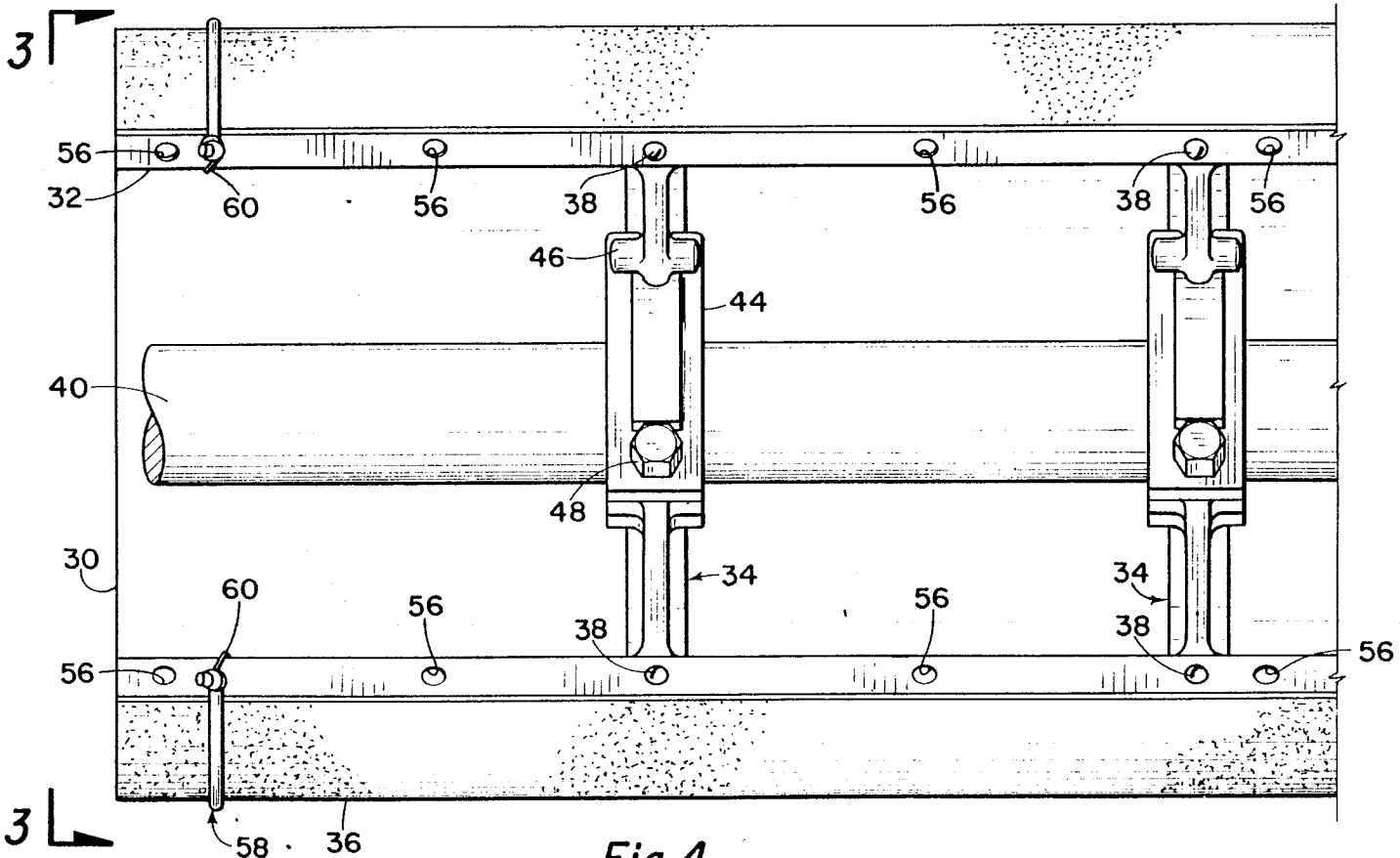
FIG. 4 is a broken plan view of an antismear device according to my invention.

In FIG. 2 I am showing an isometric view of one embodiment of my invention in detail. My antismear device 20, generally, comprises a cylindrical portion 30 of resilient material which includes axially oriented flanges 32 extending along axial ends of the cylindrical portion 30 in order to provide means for securing the cylindrical portion 30 to a series of support wheels 34, generally, which I show as wheel portions. Of course, the segment of a circle forming support wheels 34 will depend upon the geometry of the particular press used and the choice of the printer.

Cylindrical portion 30 may be constructed of thin sheet metal having suitable resiliency, or of a selected plastic sheet having Suitable resiliency. The surface of cylindrical portion 30 comrises a granular surface 36 formed either by granular material applied to the surface or as an abrasive sheet. The granular material should be spread over the entire sheet. The granular material forming surface 36 may comprise granular particles of a size and of an even distribution selected by the printer for any particular job, usually depending upon the type of paper or sheet being printed. For example, surface 36 may comprise granular particles applied to a sheet metal member, or may be particles forming the abrasive surface of a sheet of sandpaper glued to the surface of cylindrical portion 30. I have found that when I choose sandpaper, that the smaller the grain of the particles on the sandpaper, the paper of the sandpaper is softer, and consequently the softer paper adheres better to the sheet metal surface of cylindrical portion 30.

Flange 32 is secured to support wheel 34 by means of bolts 38 through flange 32 into a cooperating threaded hole in wheel 34.

Support wheel 34 is held securely to a shaft 40 within a semi-circular bed 42 of wheel 34 (shown in FIG. 3) by cooperation of plate 44 with lug member 46 against shaft 40 by means of tightening of bolt 48 into correspondingly threaded receptacle 50 within U-shaped portion 52 of support wheel 34. Thus, tightening of bolt 48 provides leverage action with lug member 46 to cause a raised portion 54 of plate 44 to press against shaft 40.

Thus, as may be easily understood, the wheels 34 may be easily and quickly adjusted axially along shaft 40 by slidable movement, and tightening of plate member 44, and consequently, with corresponding attachment of cylindrical portion 30 at various chosen points along flange 32 by positioning of bolts 38 through suitable holes 56. In this manner the printer may adapt the antismear device 20 to all the factors of each printing Job, such as, the kind, form, and properties of the paper stock or other material being used in the printing operation, as well as the properties of the cylindrical portion and granular surface.

Figure 3:
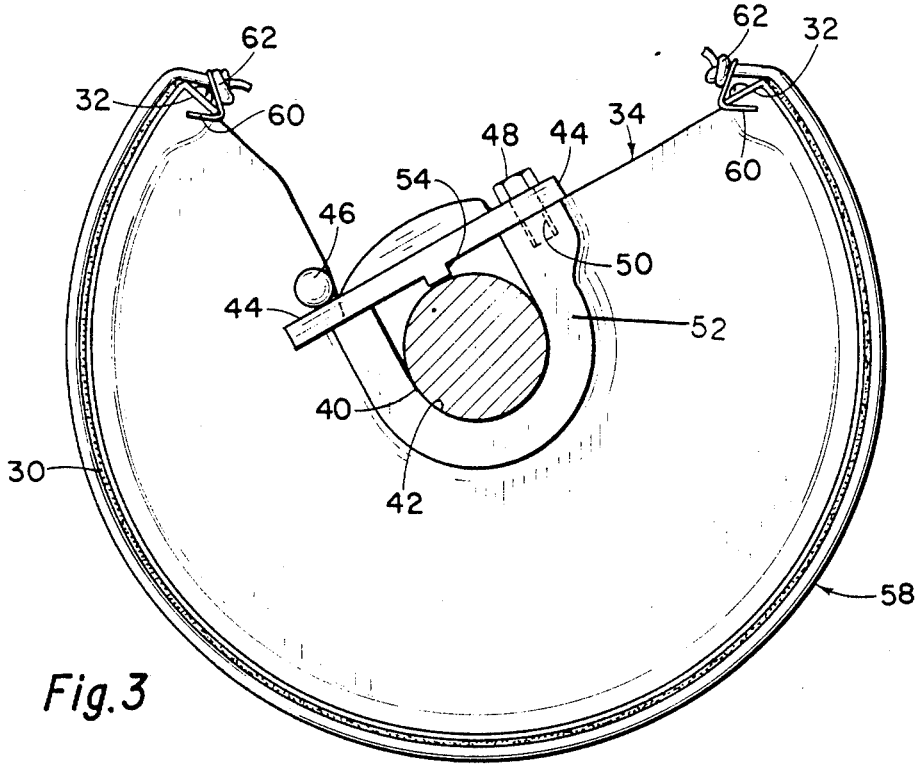
FIG. 3 is a side view of an antismear device according to my invention.

For enhancing the antismearing capabilities afforded by granular surface 36 of my antismear device, I have provided elastic members 58, generally, which are stretchable around the cylindrical portion 30 and connectible at each flange 32 by means of hooks 60, which, as shown most clearly in FIG. 3, are secured to elastic members 58 by knots 62. Elastic members 58 are preferably strong, stretchable, cord-like components of a diameter most suited to the printing job present1y being performed, as typical examples of diamters from one-sixteenth to one-quarter inch. Elastic members 58 may be easily and quickly positioned slidably along flange 38 by movement of hooks 60 to positions most advantageous for the particular job.

In the partial plan view of FIGURE I am showing, for easier understanding, the relationship of the various components.

Since many different embodiments of this invention may be made without departing from the spirit and scope thereof, it is to be understood that the specific embodiments described in detail herein are not to be taken in a limiting sense, since the scope of the invention is best defined by the appended claims.

I claim:

1. A method for preventing the smearing on ink of a freshly inked sheet of paper as it moves through a printing press, comprising the steps of:

providing a printing press having a blanket cylinder, an impression cylinder, and a transfer cylinder, providing the transfer cylinder with a cylindrical portion, providing the cylindrical portion of the transfer cylinder with an axially oriented flange at each axial end thereof, providing a pair of elastic members, each elastic member having a hook each end there of, attaching each elastic member to the cylindrical portion by securing each hook cooperably with each flange and stretching each elastic member around the circumferential surface of the circular portion, examining properties of material to be printed so as to choose a position along the flange members for the elastic members to provide an efficient antismearing capacity for the transfer cylinder, and adjusting the elastic members axially along the flange members to chosen positions for the elastic members around the cylindrical portion so as to provide a minimum area of contact of the elastic members with printed areas of the freshly inked sheet.

2. A method for preventing the smearing of ink on a freshly inked sheet as described in claim 1, including the step of:

adjusting the elastic members slidably along the flange members.

3. A method for preventing the smearing of ink on a freshly inked sheet as described in claim 2, wherein:

the cylindrical portion comprises a sheet of resilient material having a granular surface.

4. A method for preventing the smearing of ink on a freshly inked sheet as described in claim 3, wherein:

each elastic member comprises a cord-like stretchable member.

5. An antismear transfer cylinder for a printing press, comprising:

a support wheel having means for mounting on a rotatable shaft of a printing press, a cylindrical portion formed by mounting a sheet of resileint material around the support wheel, the cylindrical portion having an outer circumferential granular surface, an axially oriented flange along each axial end of the cylindrical portion including means for securing the flange to the support wheel, an elastic member, having a hook secured at each end thereof, attachable to each flange by means of each hook and stretchably positionable around the circumferential granular surface, the hooks slidably adjustable along each flange to a chosen position to provide efficient antismear capacity.

6. A antismear transfer cylinder as described in claim 5, wherein:

the cylindrical portion comprises circumferentially more than half a cylinder.

7. An antismear transfer cylinder as described in claim 6, which includes two elastic members, each adaptable to be attachable to each flange in a manner that each elastic member may be stretchably positionable around the circumferential granular surface.

8. An antismear transfer cylinder as described in claim 7, wherein:

the granular surface comprises granular material applied to the circumferential surface of the cylindrical portion.

9. An antismear transfer cylinder as described in claim 8, wherein:

the granular material applied to the circumferential surface includes a sheet coated with granular material adhesively secured to the surface of the cylindrical portion.

10. An antismear transfer cylinder as described in claim 9, wherein:

each elastic member comprises a cord-like stretchable member.

11. In a printing press having a plate cylinder, a blanket cylinder, an impression cylinder, means for supplying ink to the plate cylinder, and means for conveying freshly-printed copy, wherein an improvement comprises:

an antismear cylinder operably mountable within the press adjacent the impression cylinder, and including:

a support wheel axially mountable on a shaft operably mounted in the printing press, a cylindrical portion formed by mounting a sheet of resilient material around the support wheel, the cylindrical portion having an outer circumferential granular surface, an axially oriented flange along each axial end of the cylindrical portion including means for securing each flange to the support wheel, and an elastic member, having a hook secured at each end thereof, attachable to each flange by means cf each hook and stretchably positionable around the circumferential granular surface, the hooks slidably adjustable along each flange to a chosen location to provide efficient antismear capacity.

12. The invention as described in claim 11, wherein:

the cylindrical portion comprises circumferentially more than half a cylinder.

13. The invention as described in claim 12, which includes two elastic members, each adaptable to be attachable to each flange in a manner that each elastic member may be stretchably positionable around the circumferential granular surface.

14. The invention as described in claim 13, wherein:

the granular surface comprises granular material applied to the circumferential surface of the cylindrical portion.

15. The invention as described in claim 14, wherein:

the granular material applid to the circumferential surface includes a sheet coated with granular material adhesively secured to the surface of the cylindrical portion.

16. The invention as described in claim 15, wherein:

the elastic member comprises a cord-like stretchable member.

* * * * *